US005911266A

United States Patent [19]

Jacobs

[11] Patent Number: 5,911,266

[45] Date of Patent: Jun. 15, 1999

[54] APPARATUS FOR SUPPORTING A FABRIC OVER AN APERTURE

[76] Inventor: Steven Jacobs, 121 Eton Ave., Sudbury, Wembley, Middlesex HA0 3BA, United Kingdom

[21] Appl. No.: 08/847,039

[22] Filed: May 1, 1997

[30] Foreign Application Priority Data

May 3, 1996 [GB] United Kingdom ..... 9609318

[51] Int. Cl.[6] ..... A47H 13/00

[52] U.S. Cl. ..... 160/368.1; 160/330; 248/206.5; 248/261

[58] Field of Search ..... 160/368.1, 330, 160/DIG. 16; 248/261, 262, 206.5, 309.4

[56] References Cited

U.S. PATENT DOCUMENTS

| | | | |
|---|---|---|---|
| 738,287 | 9/1903 | Brown | 160/330 |
| 751,906 | 2/1904 | Foster | 160/330 |
| 1,176,312 | 3/1916 | Petrusha et al. | 160/330 |
| 1,837,046 | 12/1931 | Hirschberger | 160/330 |
| 2,343,813 | 3/1944 | Simon | 160/DIG. 16 |
| 4,103,728 | 8/1978 | Burdette et al. | 160/368.1 |
| 4,228,980 | 10/1980 | Beauchamp et al. | 160/330 X |
| 5,090,469 | 2/1992 | Boulanger | 160/368.1 |
| 5,385,194 | 1/1995 | Brown | 160/368.1 X |
| 5,398,900 | 3/1995 | Schober | 248/251 |

FOREIGN PATENT DOCUMENTS

| | | | |
|---|---|---|---|
| 683595 | 4/1964 | Canada | 160/330 |
| 12367390 | 5/1968 | Germany | 160/330 |
| 1020329 | 2/1966 | United Kingdom . | |

*Primary Examiner*—Blair M. Johnson

*Attorney, Agent, or Firm*—Faustino A. Lichauco; Lahive & Cockfield, LLP

[57] ABSTRACT

Apparatus for supporting fabric such as a net curtain 5 over an aperture such as a window comprises first and second members 4 and 2 respectively which have exposed faces which are mutually magnetically attractive, the sacond member 2 being L-shaped to provide below its exposed face a ledge for supporting the first member 4.

11 Claims, 2 Drawing Sheets

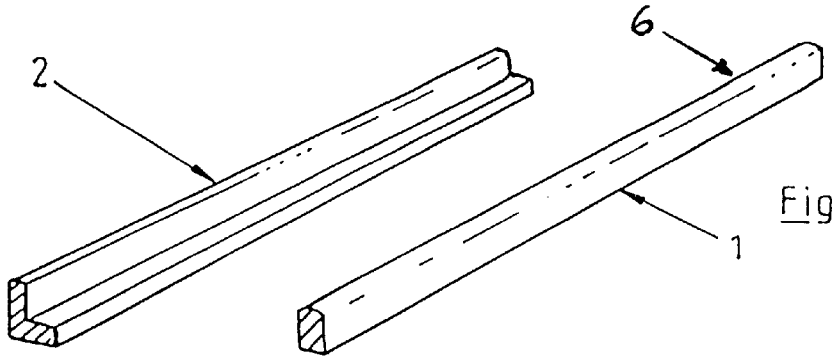
Figure 1
Figure 2
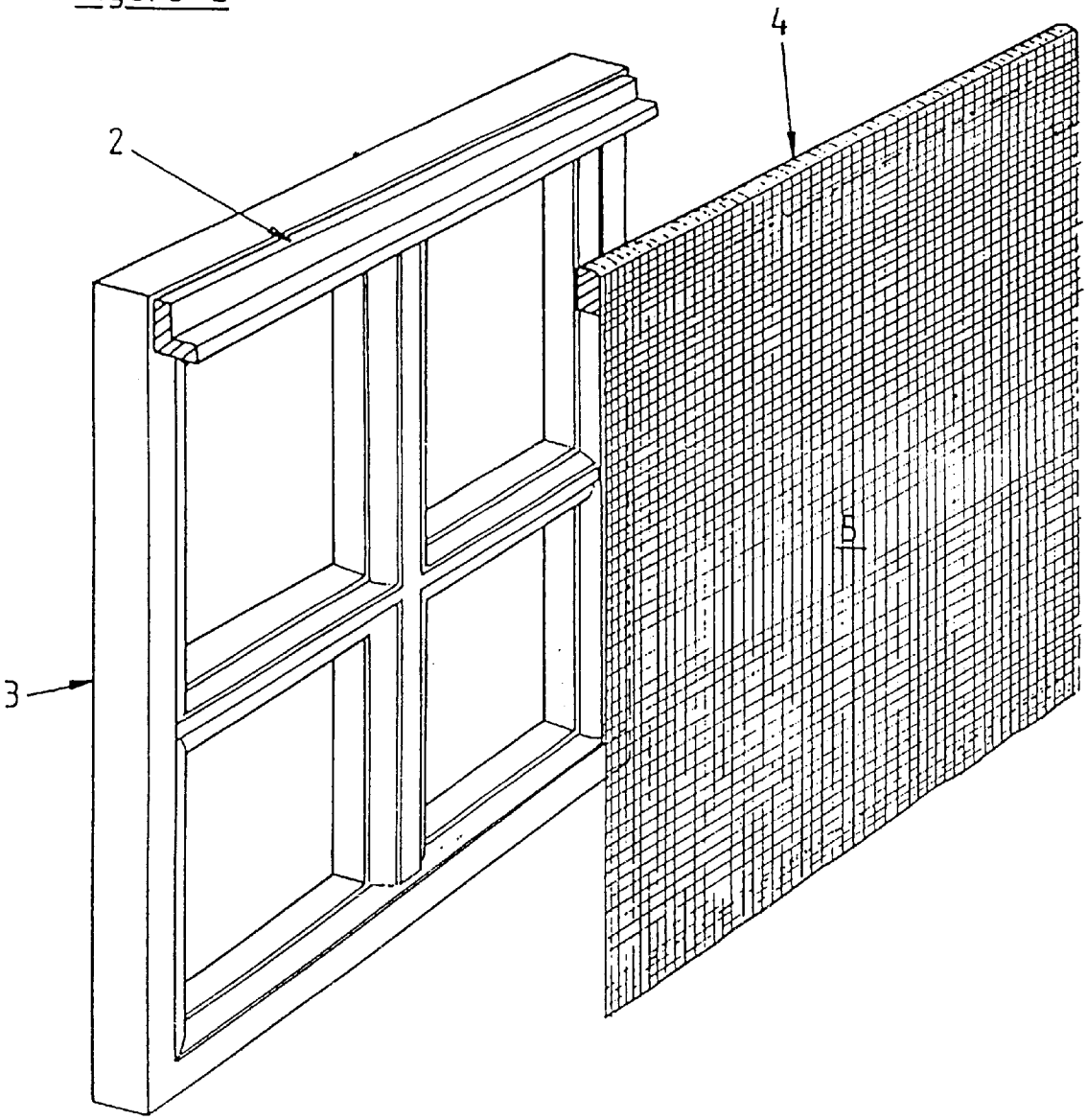
Figure 3

APPARATUS FOR SUPPORTING A FABRIC OVER AN APERTURE

The present invention relates to apparatus for supporting a fabric over an aperture such as a net curtain over a window.

Net curtains are often used to prevent persons from seeing through a window into a building whilst still allowing light to pass through. Such curtains are suspended over the window by an expandable length of wire passing through a sleeve in the top of the net curtain. The length of wire has an eye at either end which engages a hook on either side of the window frame. A difficulty with this system is that in order to obtain sufficient tension in the wire to prevent the curtain from sagging, the wire has to be stretched considerably. It can be difficult for some persons to apply sufficient force to stretch the wire, e.g. the elderly, making it difficult to take down and erect such curtains when it is desired to clean them. Also the wire tends to stretch under tension resulting in the wire sagging, and this makes the net curtain sag which is unsightly.

The invention seeks to provide alternative means for hanging net curtains and other fabric over apertures such as windows.

According to the present invention there is provided apparatus for supporting fabric over an aperture, the apparatus comprising first and second members which have exposed faces which are mutually attractive magnetically, the second member being substantially L-shaped to provide below its exposed face a ledge for supporting the first member.

In one embodiment of the invention the first and second members are strips or lengths of material at least one of which is magnetic.

The first member may comprise a strip of magnetic material engaged in a C-shaped coating and movable longitudinally relative to the coating.

The second member may comprise a strip of magnetic material engaged in an L-shaped coating which provides the ledge for supporting the first member.

A plurality of first members may be secured together to provide an axially extended member.

Further, according to the present invention, there is provided a method of securing a fabric over an aperture, the method comprising locating at least one first member in one or more pockets or sleeves in the fabric, locating at least one second member at the periphery of the aperture, the first and second members having exposed faces which are mutually attractive magnetically, the second member being substantially L-shaped to provide below its exposed face, a ledge for supporting the first member.

The fabric may be a net curtain and the aperture may be a window.

The fabric may also be a rectangular "mosquito net" having four sleeves for mounting over a rectangular window. The device includes four first members in the form of elongate strips of material for insertion in each sleeve, and four second members in the form of elongate strips of material for mounting adjacent to the four peripheral edges of the window.

An embodiment of the invention will now be described with reference to the accompanying drawings in which:

FIG. 1 is a perspective view of a first member;

FIG. 2 is a perspective view of a second member;

FIG. 3 is a perspective view of the first and second members supporting a net curtain over a window;

Figure 5:
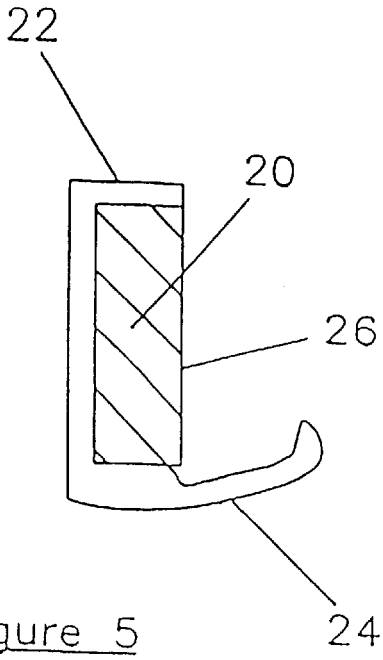
FIGS. 4 and 5 are respectively cross sections of preferred embodiments of first and second members.

Referring to FIG. 1, there is shown a substantially rectangular strip 1 forming a first member of magnetic or metallic material for attachment to a fabric by, for example, placement in one or more pockets or sleeves in the fabric. The strip may be formed from a metal, such as steel, or it may be formed of magnetic material, such as, plastic impregnated with magnetic particles or metal, or plastics with a strip of magnetic material or a series of magnets along its length.

Referring to FIG. 2, there is shown a substantially L-shaped strip 2 forming a second member of magnetic or metallic material for attachment around at least part of the periphery of a window or other aperture, e.g. by means of adhesive, screws or nails. The L-shaped strip may be formed from a metal such as steel, or it may be formed of magnetic material such as, for example, plastic impregnated with magnetic particles or metal, or plastics with a strip of magnetic material or series of magnets along its length.

In the example of FIGS. 1 and 2, the rectangular strip 1 is of a size to engage with the L-shaped strip 2 and to be supported by the L-shaped strip 2. Strip 1 may be of magnetic material and L-shaped strip 2 may be of metallic material attracted to magnetic material or vice versa. Alternatively both strip 1 and 2 may be of magnetic material which attract each other, the strips having exposed faces which, properly oriented, attract each other. Such magnetic strips, if improperly oriented, repel each other and the strip 1 is provided with a mark to indicate the proper orientation, the mark in this embodiment being a fine line or ridge 6 running along a surface of the strip, in this embodiment the top surface.

Referring to FIG. 3, the strip 2 of FIG. 2 is mounted along the upper edge of a rectangular window frame 3. Strip 1 of FIG. 1 is located, ridge 6 uppermmost, inside a sleeve 4 formed along the upper edge of a net curtain 5. The curtain 5 is supported on the window by engaging the strip 1 with the L-shaped strip 2. The curtain 5 can easily be removed for cleaning by disengaging the strip 1 from strip 2, and removing the strip 1 from the sleeve 4. Instead of the strip 1 being inserted into the sleeve 4, it could be interwoven, stitched or otherwise attached to the fabric.

A mosquito net may also be formed by applying four strips similar to the strip 2 around all four edges of the window frame 3 and providing four pockets around net material in which four strips similar to the strip 1 are placed. All edges of the material would be secured to the frame thus preventing mosquitoes from passing through the window.

The invention may also have other uses, e.g. to secure fabric to a window to support broken glass in the event of an explosion, or to support a pelmet valance.

The first and second members may take any suitable form other than that specifically described. For example the first member could be in the form of magnetic or metallic particles coated on or impregnated into the fabric, and the second member could also or alternatively be in the form of magnetic or metallic particles coated on or impregnated into a substrate such as a window frame.

It is also possible for a window frame itself to be formed of magnetic material and/or be metallic. Thus the window frame itself would form the second member.

Figure 4:
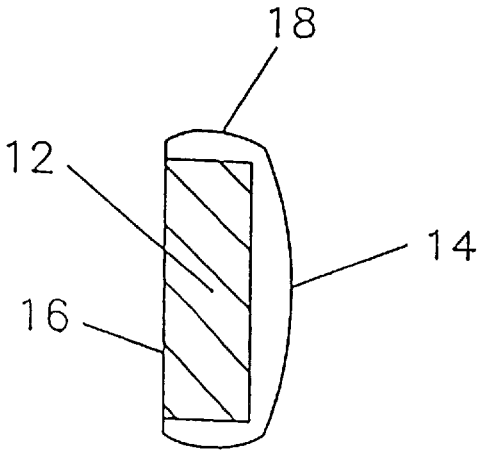

A preferred embodiment of the first member is shown in FIG. 4 and consists of a rectangular strip 12 of magnetic plastics, i.e. a strip of flexible plastics material impregnated with magnetic particles, located within or embraced by a C-shaped UPVC plastics coating 14. The coating 14 leaves one face 16 of the strip 12 exposed. The strip 12 is movable relative to the coating 14 in the longitudinal direction. To ensure correct orientation of the strip 12 relative to the second member, a fine line or ridge 18 is provided at the top of the coating 14.

In FIG. 5 is shown the preferred embodiment of the second member for use with the first member of FIG. 4. The second member consists of a rectangular strip 20 of magnetic plastics embraced by an L-shaped UPVC plastics coating 22, the base of the L being a shelf or ledge 24. Again, one face 26 of the strip 20 is left exposed to cooperate with the exposed face 16 of the strip 12.

Figure 6:
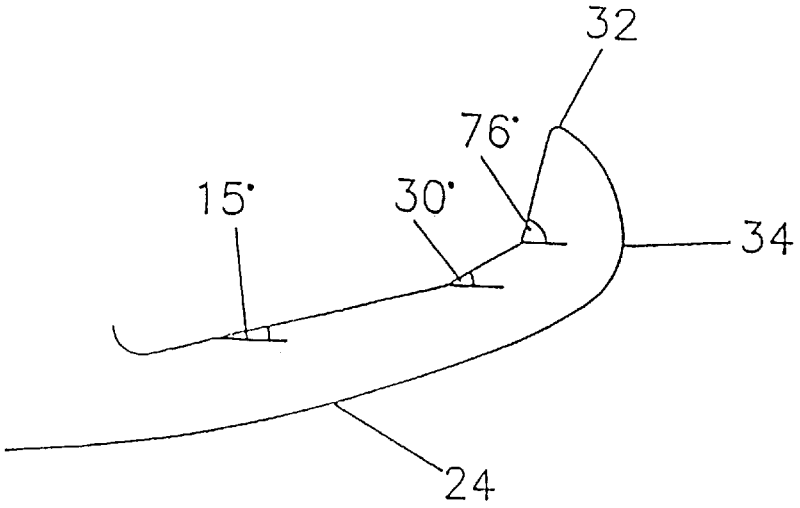
FIG. 6 is an enlarged view of part of FIG. 5.

As shown in FIG. 6, the ledge 24 beneath the exposed face 26 is inclined upwardly at a shallow angle which is preferably in the range 15 to 20 degrees, in this embodiment 15 degrees. Further out the inclination of the upper surface of the ledge is increased substantially to about double the general inclination; in this embodiment the inclination is increased to 30 degrees. The final 2 mm of the upper surface is steeply inclined at between 70 and 80 degrees, in this embodiment 76 degrees. The ledge terminates in a rounded nose 32 which in this embodiment has a radius of 0.2 mm, the nose being connected to the bottom surface of the ledge by a smooth curve having a radius of 2.0 mm.

In use, the first member is supported on the ledge 24 and the inclination of the ledge 24 helps to ensure that the two exposed faces on the members are accurately positioned relative to each other for maximum relative attraction.

Figure 7:
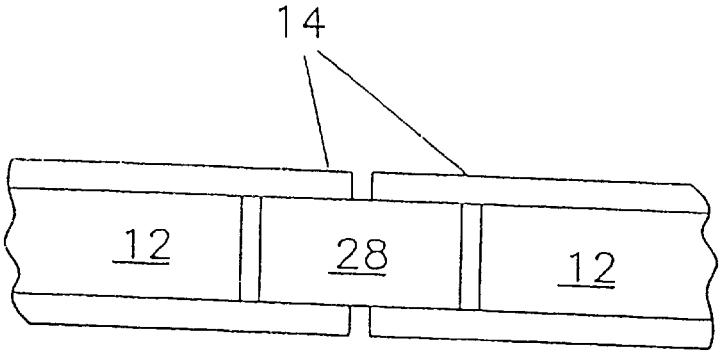
FIG. 7 is an elevation of the connection between two lengths of the first member of FIG. 4.

For convenience, the members are provided in standard lengths which are easily cut to provide shorter lengths, but if longer lengths are desired they can be provided as shown in FIG. 7 where two lengths of first member are connected by a bridging piece 28. To provide room for the piece 28 the magnetic strips 12 are shortened and slid longitudinally along in their respective coatings 14 to leave room for the bridging piece 28 which has the same cross section as the strips 12 and can also be slid longitudinally into the coatings 14. Thus longer lengths of the first member can be fabricated if desired, and the connection of the two lengths can be made permanent, if desired, by glue or other suitable means.

The bridging pieces can be made relatively rigid if we are concerned with a straight run of window, for example, but if the problem is a bay window then it may be desirable to use bridging pieces that are more flexible and can accomodate the angles between the various sections of the window.

In principle, longer lengths of the second member can be similarly fabricated but in practice there is no real need as the various lengths of the second member are simply secured in position around the periphery of the window.

Thus, it can be seen that the embodiments of FIGS. 4 and 5 with their coatings are not only more pleasing aesthetically but also allow for the fabrication of the extended lengths of the first member.

Having described the invention and a particular embodiment thereof, what is claimed as new and secured by Letter Patent is:

1. Apparatus for supporting fabric over an aperture having a periphery, the apparatus comprising a first member for attachment to the fabric, the first member including a C-shaped coating, and a first elongated strip engaged in the C-shaped coating, the first elongated strip being movable longitudinally relative to the C-shaped coating and having a first exposed face, and a second member for attachment to at least part of the periphery of the aperture, the second member including a second elongated strip having a second exposed face, and a supporting ledge projecting from the second exposed face for supporting the first member, wherein the first exposed face and the second exposed face are mutually attractive magnetically.

2. Apparatus as claimed in claim 1, in which the second member comprises an L-shaped coating providing the supporting ledge, and a strip of magnetic material seated in the L-shaped coating.

3. Apparatus as claimed in claim 1, in which the first member comprises a plurality of sections secured together by at least one bridging piece.

4. Apparatus as claimed in claim 2, further comprising a fabric having a pocket adapted to contain the first member.

5. Apparatus as claimed in claim 1 wherein at least one of the strips includes a mark to indicate a preferred orientation of the at least one of the strips.

6. Apparatus as claimed in claim 1 wherein the supporting ledge is inclined relative to the second exposed face.

7. Apparatus as claimed in claim 3 therein the bridging piece is more flexible than said first member.

8. A method of securing a fabric over an aperture formed by a periphery, the method comprising the steps of locating at least one first member in at least one integrated receptacle in the fabric, locating at least one second member at the periphery of the aperture, the first member including a first elongated strip having a first exposed face and the second member including a second elongated strip coextensive with the first elongated strip, the second member having a second exposed face and, below the second exposed face, a supporting ledge for supporting the first member, the first and second exposed faces being mutually attractive magnetically.

9. A method as claimed in claim 8, in which the fabric is a net curtain and the aperture is a window.

10. A method as claimed in claim 8, in which the aperture is a rectangular window and the fabric is a rectangular mosquito net for mounting over the window, the net having a sleeve on each of its four sides, and the method comprises the step of inserting a first member into each of the sleeves.

11. A method as claimed in claim 8, further comprising the step of selecting the fabric to be a valance.

* * * * *